US006565387B2

(12) United States Patent
Cohen

(10) Patent No.: US 6,565,387 B2
(45) **Date of Patent: *May 20, 2003**

(54) MODULAR ELECTRICAL CONNECTOR AND CONNECTOR SYSTEM

(75) Inventor: Thomas S. Cohen, New Boston, NH (US)

(73) Assignee: Teradyne, Inc., Boston, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/345,821

(22) Filed: Jun. 30, 1999

(65) Prior Publication Data

US 2001/0044235 A1 Nov. 22, 2001

(51) Int. Cl.[7] ..... H01R 13/648
(52) U.S. Cl. ..... 439/608; 439/79; 439/108
(58) Field of Search ..... 439/607–610, 439/108, 79

(56) References Cited

U.S. PATENT DOCUMENTS

| | | | | | |
|---|---|---|---|---|---|
| 3,915,546 | A | | 10/1975 | Cobaugh et al. | 439/876 |
| 5,066,236 | A | * | 11/1991 | Broeksteeg | 439/79 |
| 5,342,211 | A | | 8/1994 | Broeksteeg | 439/108 |
| 5,403,206 | A | | 4/1995 | McNamara et al. | 439/608 |
| 5,496,183 | A | | 3/1996 | Soes et al. | 439/79 |
| 5,507,655 | A | | 4/1996 | Goerlich | 439/108 |
| 5,645,436 | A | * | 7/1997 | Shimizu et al. | 439/608 |
| 5,664,968 | A | | 9/1997 | Mickievicz | 439/608 |
| 5,743,765 | A | * | 4/1998 | Andrews et al. | 439/608 |
| 5,795,191 | A | | 8/1998 | Preputnick et al. | 439/608 |
| RE35,896 | E | * | 9/1998 | Brunker et al. | 439/608 |
| 5,904,594 | A | * | 5/1999 | Longueville et al. | 439/608 |
| 5,993,259 | A | * | 11/1999 | Stokoe et al. | 439/608 |
| 6,083,047 | A | * | 7/2000 | Paagman | 439/608 |

FOREIGN PATENT DOCUMENTS

| | | |
|---|---|---|
| EP | 0394558 | 10/1990 |
| EP | 0486298 | 11/1991 |
| EP | 0638967 | 7/1994 |
| WO | 9736349 | 2/1997 |
| WO | 9835409 | 1/1998 |
| WO | 9808276 | 2/1998 |

* cited by examiner

*Primary Examiner*—Hien Vu
(74) *Attorney, Agent, or Firm*—Daly, Crowley & Mofford, LLP

(57) ABSTRACT

A modular connector system for interconnecting printed circuit boards includes a first connector having an insulative housing supporting an array of blade-shaped contacts and a second connector having a complementary array of beam-shaped contacts. Preferably, each beam-shaped contact includes substantially independent coplanar beams which, in use, contact a common surface of a respective blade-shaped contact to provide multiple points of contact. The second connector includes a plurality of modules stacked in parallel. Each module includes a shield plate having an insulative receptacle attached at one end and a row of signal conductors, each having a beam-shaped contact at one end. Each insulative receptacle has a first side in which cavities are provided to receive the beam-shaped contacts of the signal conductor. Each insulative receptacle further includes a second, opposite side in which holes are formed in substantial alignment with the cavities for receiving the blade-shaped contacts of the first connector.

22 Claims, 13 Drawing Sheets

MODULAR ELECTRICAL CONNECTOR AND CONNECTOR SYSTEM

CROSS-REFERENCE TO RELATED APPLICATIONS

Not applicable.

STATEMENTS REGARDING FEDERALLY SPONSORED RESEARCH

Not applicable.

BACKGROUND OF THE INVENTION

Electrical connectors are used in many electronic systems. It is generally easier and more cost effective to manufacture a system on several printed circuit boards which are then joined together with electrical connectors. A traditional arrangement for joining several printed circuit boards is to have one printed circuit board serve as a backplane. Other printed circuit boards, called daughter boards, are connected to the backplane, often with right angle connectors. Conductive traces on the backplane connect to signal contacts in the connectors to route signals between the connectors and thus, between daughter boards.

Connectors are also used in other configurations for interconnecting printed circuit boards and for connecting cables to printed circuit boards. Sometimes, one or more small printed circuit boards are connected to another larger printed circuit board. The larger printed circuit board is called a "mother board" and the printed circuit boards plugged into it are called daughter boards. Also, boards are sometimes aligned in parallel. Connectors used in these applications are sometimes called "stacking connectors" or "mezzanine connectors."

Electrical connector designs are generally required to mirror trends in the electronics industry. In particular, connectors are required to operate at higher signal speeds and to handle more data in the same space (i.e., to have a higher density). To meet the needs of electronic systems, some electrical connectors include shield members. Shield members are used to control impedance and crosstalk between signals so that the signal conductors can be more closely spaced.

Another requirement of electrical connectors is to meet the growing market needs for customized connector systems. One way to address this requirement is with the use of modular connectors. Teradyne Connection Systems of Nashua, N.H., USA pioneered a modular connector system called HD+®, with the modules organized on a stiffener. Each module has multiple columns of signal contacts, such as 15 or 20 columns. The modules are held together on a metal stiffener.

A further requirement of some electrical connectors is redundant signal contacts. One type of electrical connector which provides redundant signal contacts may be referred to as a box connector or a pin and socket connector and includes box-shaped sockets for receiving pins. More particularly, each box-shaped socket includes a base positioned in a first plane of an imaginary box and two prongs positioned orthogonally with respect to the base, along two opposing sides of the box, to form a "U-shaped" socket.

Conventional box connectors provide redundant signal contacts since each socket generally wraps around and contacts at least two sides of a pin. However, such connectors tend to be relatively large since the opposing prongs of the sockets are positioned orthogonally with respect to the base. Further, the relatively large size of such sockets limits the spacing between adjacent sockets and the signal conductors extending from the sockets, thereby disadvantageously tending to increase signal crosstalk.

Redundant signal contacts have been used in card edge connectors in which a first printed circuit board having contacts on an edge is plugged into a card edge connector mounted on a second printed circuit board. In one such arrangement, the card edge connector on the second board includes a header in which a plurality of spring contacts are disposed, with each spring contact including two adjacent fingers. Upon insertion of the first printed circuit board into the card edge connector, each edge contact on the first printed circuit board contacts two adjacent spring fingers.

SUMMARY OF THE INVENTION

With the foregoing background in mind, it is an object of the invention to provide a high signal speed, high density electrical connector.

It is a further object to provide a connector having redundant signal contacts.

It is also an object to provide a connector utilizing low profile contacts to permit increased spacing between contacts and conductors and also to provide a connector with shields between rows of conductors in order to reduce signal crosstalk.

Yet another object of the invention is to provide a modular connector that allows for easy and flexible manufacture and further allows close and tightly controlled spacing between signal contacts, signal conductors and shields.

The foregoing and other objects are achieved with a connector system that provides electrical connection between circuit boards by mating blade-shaped contacts of a first connector with beam-shaped contacts of a second, modular connector. The modular connector includes a plurality of shield plates mounted in parallel and a plurality of signal conductors, each having a beam-shaped contact positioned substantially parallel to the shield plates. Preferably, each of the beam-shaped contacts includes substantially coplanar and independent beams which are adapted for contacting a common surface of a respective blade-shaped contact.

With this arrangement, a board-to-board connector system is provided with redundant signal contact points, but with higher signal density and/or reduced crosstalk than heretofore achieved with the use of conventional box connectors. This is because the redundant beam contacts of the present invention have a lower profile than conventional box-shaped sockets and contact only a single surface of a low profile blade-shaped contact. In this way, improved signal integrity is provided for high speed signals.

The first connector includes an insulative housing supporting an array of contacts and the second, modular connector includes a complementary array of beam-shaped contacts. Each of the contacts of the first connector has a conductive member at a first end for electrically connecting to a first circuit board and a blade-shaped contact at a second end. Each of the beam-shaped contacts of the second, modular connector is positioned at a first end of a signal conductor which has a conductive element adapted for electrically connecting to a second circuit board at a second end.

The modular connector includes a plurality of shield subassemblies and a corresponding plurality of signal subassemblies, with each shield subassembly/signal subassembly pair providing a module. Multiple modules are stacked in parallel to provide the modular connector.

In one embodiment, each shield subassembly is provided by molding an insulative receptacle over a portion of a shield plate and each signal subassembly is provided by inserting a plurality of signal conductors into a molded insulative member to form a row of signal conductors. Each signal subassembly is attached to a respective shield subassembly to form a module in which the beam-shaped contacts of the signal conductors are positioned substantially parallel to the shield plate.

In one embodiment, each insulative receptacle has a cavity in one side for receiving the beam-shaped contact of a respective signal conductor and a hole in an opposing side in substantial alignment with the cavity. With this arrangement, a blade-shaped contact of the first connector inserted into a hole of the insulative receptacle contacts a respective beam-shaped contact of the second, modular connector.

In accordance with a further aspect of the invention, the insulative receptacles of the shield subassemblies include a second plurality of holes, each providing access to a shield plate, and the first connector includes a plurality of shield contacts. With this arrangement, the connector system provides both signal and shield, or ground electrical interconnections between circuit boards. In this way, reflections caused by impedance discontinuities at the point of mating a two piece connector are reduced.

BRIEF DESCRIPTION OF THE DRAWINGS

The foregoing features of this invention, as well as the invention itself, may be more fully understood from the following description of the drawings in which.

DETAILED DESCRIPTION OF THE INVENTION

Figure 1:
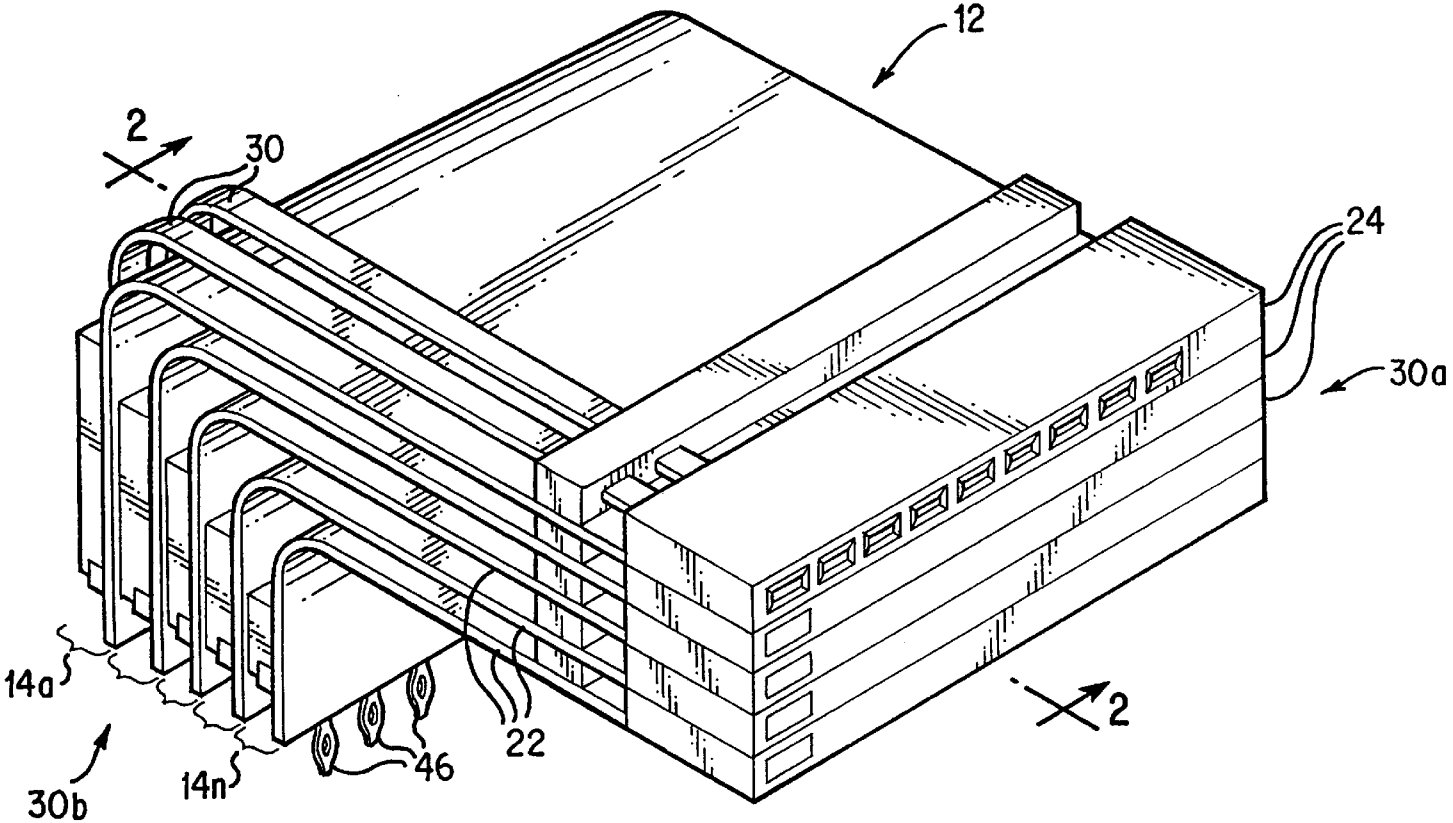
FIG. 1 is an isometric view of a modular connector according to the invention.

Referring to FIG. 1, a high signal speed, high density modular electrical connector 12 includes a plurality of shield plates 22 mounted in parallel, a plurality of insulative blade receptacle arrays, or simply receptacles 24, each attached to a respective shield plate, and a plurality of signal conductors 30. Each of the signal conductors 30 has a first end 30*a* at which is disposed a conductive element 72 (FIG. 2) adapted for being electrically connected to a printed circuit board 28 and a second end 30*b* at which is disposed a beam-shaped contact portion 70 (FIGS. 2 and 5) positioned substantially parallel with respect to the shield plates 22.

As will become apparent, the connector 12 is modular in that it includes a plurality of modules 14*a*–14*n* stacked in parallel. Each module includes a shield subassembly 16 shown and described in conjunction with FIG. 4 and a signal subassembly 18 shown and described in conjunction with FIG. 5. Each shield subassembly is attached to a respective signal subassembly to form a module and multiple modules are stacked in parallel to form the modular connector 12.

Figure 2:
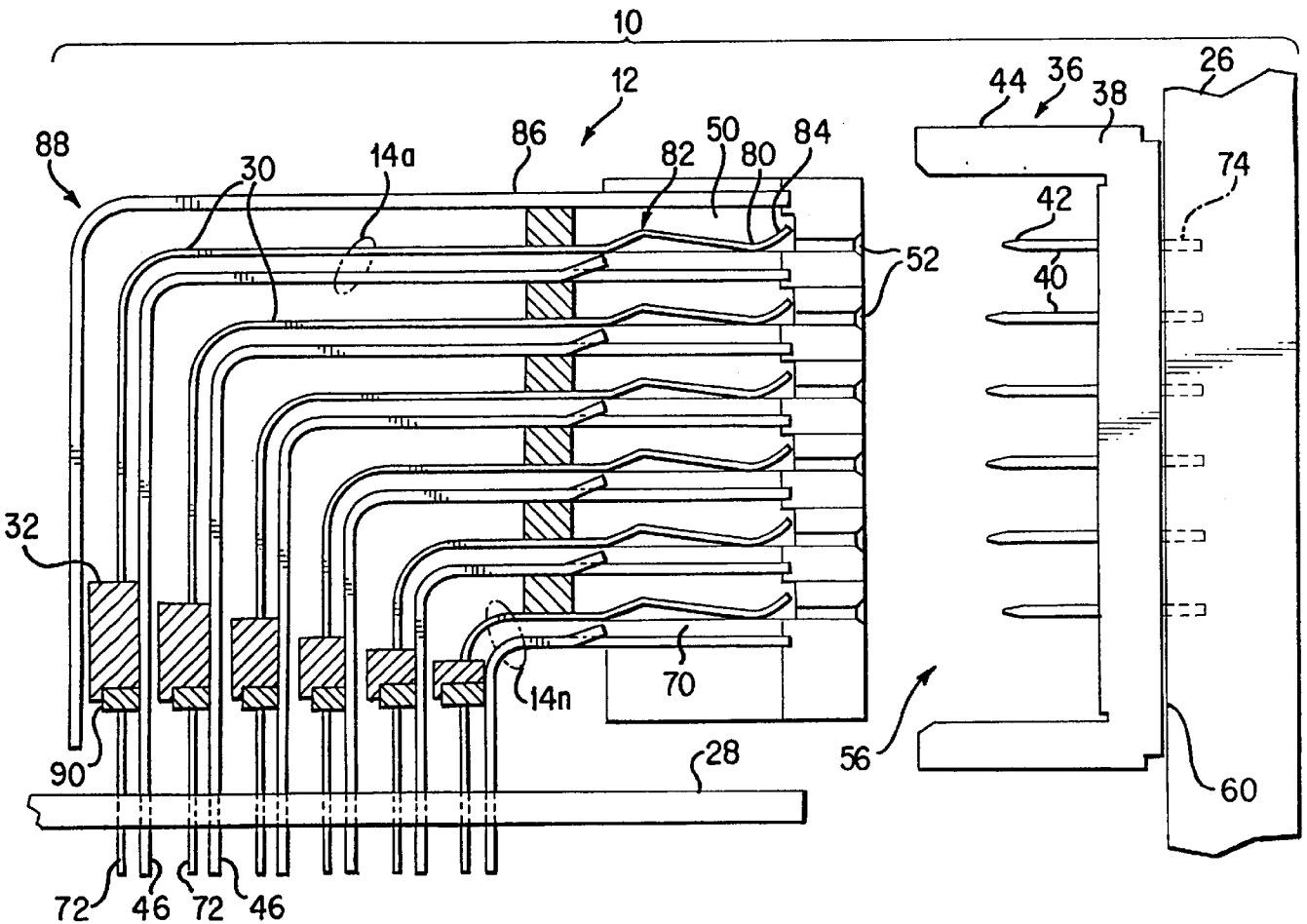
FIG. 2 is a cross-sectional side view of a modular connector system for interconnecting two printed circuit boards which includes the modular connector of FIG. 1 and a lead-in connector.

Referring also to FIG. 2, a connector system 10 which utilizes the modular connector 12 of FIG. 1 further includes a lead-in connector, or header 36 adapted for being electrically interconnected to a printed circuit board 26. More generally, the connector system 10 includes a first connector 36 including an insulative housing 38 supporting an array of signal contacts 40, each having a first end 60 at which is disposed a conductive element 74 adapted for being electrically connected to a first circuit board 26 and a second end 56 at which is disposed a blade-shaped contact portion 42. The connector system 10 further includes the second connector 12 comprising an array of beam-shaped contacts 70, each positioned at a first end 30*a* of a signal conductor 30 having a conductive element 72 adapted for being electrically connected to a second circuit board 28 at a second end 30*b*. Each beam-shaped contact 70 of the connector 12 is adapted for contacting a blade-shaped contact portion 42 of the first connector 36 when the first and second connectors are mated.

In the illustrative embodiment, the first and second boards 26, 28 are oriented at a substantially right angle with respect to one another. To accommodate this relative placement, the modular connector 12 has a substantially right angle bend 88, as shown. More particularly, the shield plates 22 and the signal conductors 30 have complementary bends, as shown. In one illustrative application, the first printed circuit board 26 is a multi-layer backplane and the second printed circuit board 28 is a daughter board. Thus, a portion of the shield plates 22 extends substantially parallel with respect to the daughter board 28, as shown. Various types of conductive elements 74 are suitable for connecting the header 36 to the circuit board 26, such as press fit contacts, surface mount elements, or solderable pins.

Preferably, the modular connector 12 includes a stiffener, or cover 86 for supporting the modules 14*a*–14*n* and for providing mechanical strength to the connector 12. The stiffener 86 further shields the signal conductors 30 of the outermost module 14*a*. Various mechanisms are suitable for securing the stiffener 86 to the stacked modules 14*a*–14*n*, such as slots on the stiffener adapted to mate with features on the one or more of the insulative members 24, 32, 64 of the outermost module 14*a*.

Figure 3:
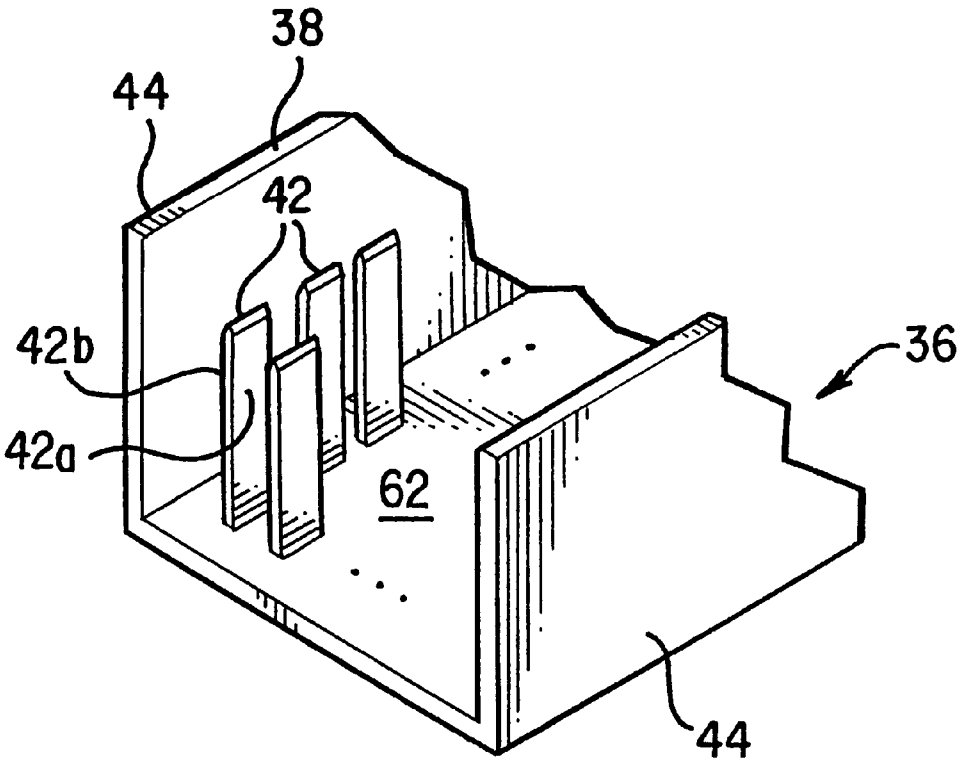
FIG. 3 is an isometric view of the lead-in connector of FIG. 2.

Referring also to FIG. 3, the blade header 36 includes an insulative housing 38 supporting the signal contacts 40. The housing 38 has end portions 44 (FIG. 2) to facilitate mating of the blade header 36 with the modular electrical connector 12. Alignment pins or other structural features may be used in addition to, or instead of the end portions 44 to guide the blade header 36 and connector 12 together during mating.

The blade-shaped contact portion 42 of each of the signal contacts 40 is an elongated, flattened member having substantially planar top and bottom surfaces 42*a*, 42*b*, respectively. Blades are generally thinner and wider than conventionally used pins, which typically have a round or other uniformly dimensioned cross-section.

In the illustrative embodiment, the signal contacts 40 are comprised of phosphor-bronze and the housing 38 is comprised of plastic. Various techniques are suitable for forming the header 36, such as inserting the signal contacts 40 into the molded plastic housing 38. As an alternative, the housing 38 may be molded around a portion of the signal contacts 40. However, it will be appreciated by those of ordinary skill in the art that both the housing 38 and the contacts 40 may be comprised of various materials and may be formed by various manufacturing techniques.

Although the number, pattern, dimensions and spacing of the header contacts 40 is not critical, it will be appreciated by those of ordinary skill in the art that in order to satisfy typical modem electrical system requirements, preferably, the contacts are spaced relatively close together and are no larger than is necessary to meet signal quality requirements, in order to provide a high density connector without the contacts being spaced so close as to result in undesirable signal crosstalk. As one example, the blade-shaped contact portion 42 of each signal contact 40 (i.e., the portion of the contact extending from the floor 62 of the housing 38) is on the order of 3 mm long, 1 mm wide and 0.3 mm thick and adjacent contacts 40 are spaced apart by 1.5 mm (i.e., are placed on 1.5 mm centers). In certain applications, it may be desirable to vary the overall length of the header contacts 40, as shown in FIG. 2, in order to control the sequence with which electrical connections are made.

Figure 4:
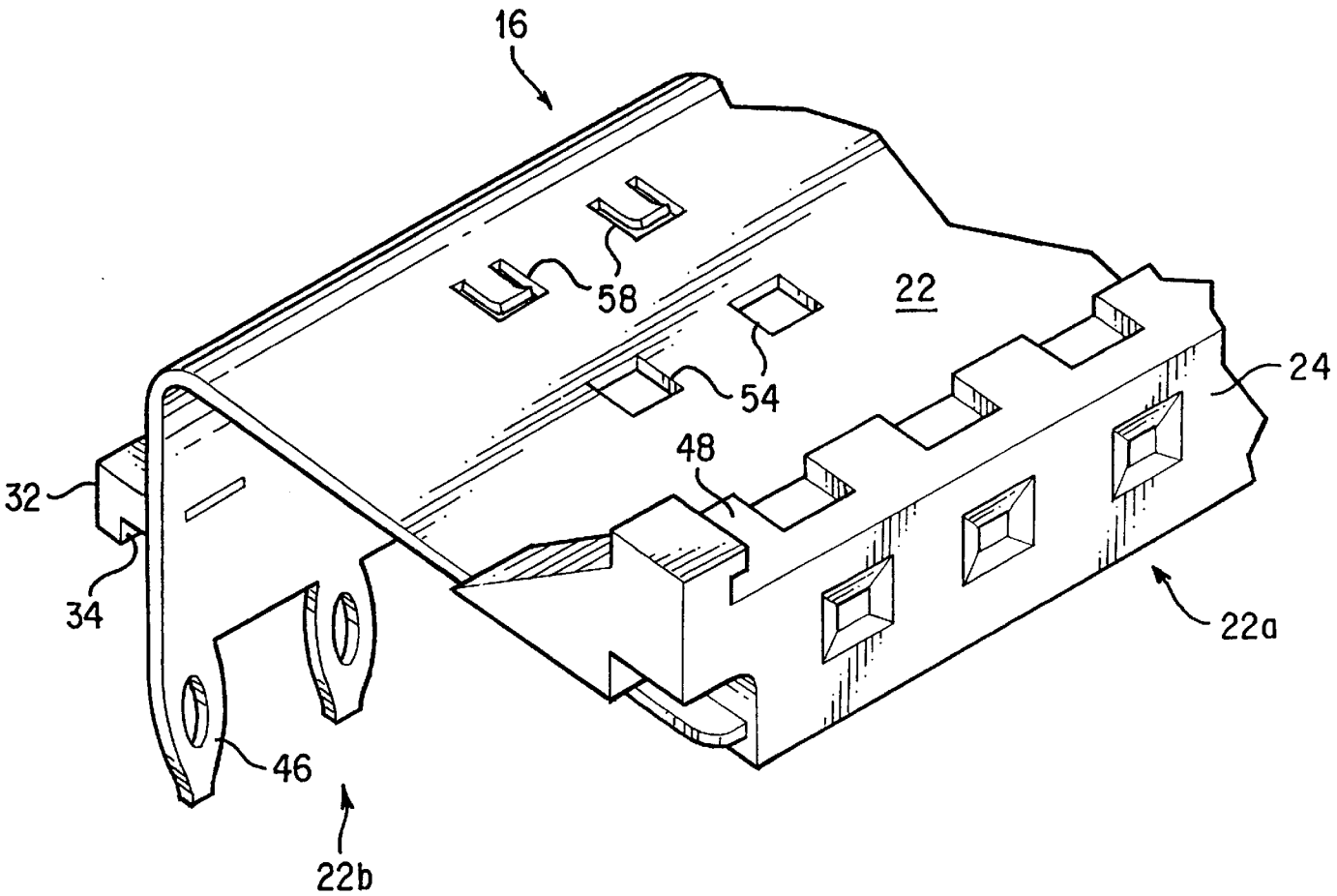
FIG. 4 is an isometric view of an illustrative shield subassembly of the modular connector of FIG. 1.

Referring also to FIG. 4, an illustrative shield subassembly 16 includes a conductive shield plate 22 having a first end 22*a* and a second end 22*b*. The shield plates are generally connected to ground and thus, may be alternatively referred to as ground return plates. An insulative blade receptacle array 24 is attached to the first end 22*a* of the shield plate 22 and a plurality of conductive elements 46 are formed along an edge at the second end 22*b*. In the illustrative embodiment, the conductive elements 46 are "eye of the needle," or "tail" elements adapted for being press fit into plated holes in the printed circuit board 28 (FIG. 2). It will be appreciated by those of ordinary skill in the art however, that the conductive elements 46 may take various forms, such as surface mount elements, spring contacts, solderable pins, etc.

Figure 5:
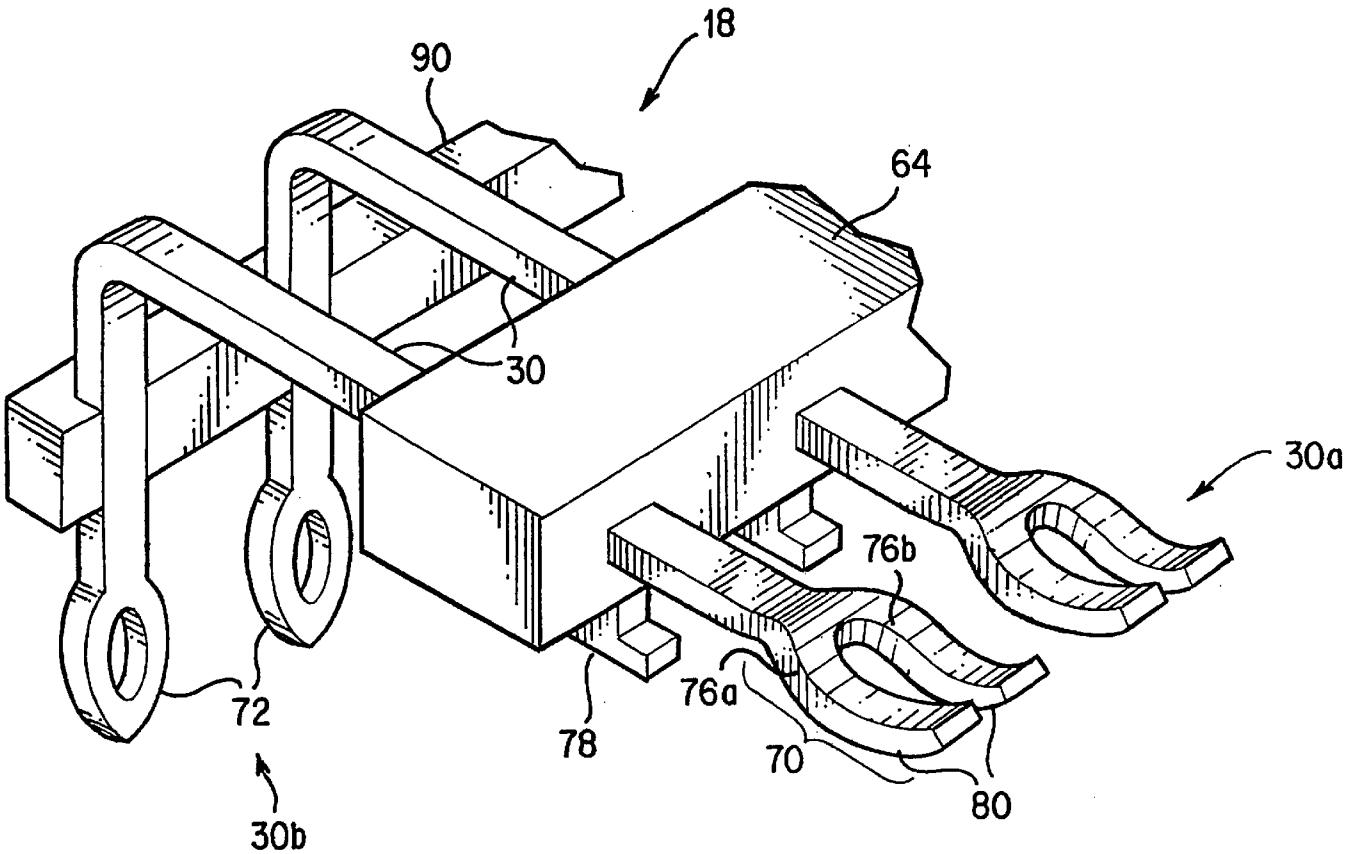
FIG. 5 is an isometric view of an illustrative signal subassembly of the modular connector of FIG. 1.

Additional features of the shield plate 22 include apertures 54 adapted to engage an attachment mechanism 78 of a respective signal subassembly 18 (FIG. 5). The shield plate 22 further includes cantilevered signal retention tabs 58 which are described below in conjunction with FIG. 6.

The insulative receptacle 24 includes a plurality of cavities 50 (FIG. 2), each one adapted to receive the beam-shaped contact portion 70 of a respective signal conductor 30. The insulative receptacle 24 further includes a plurality of holes 52, each corresponding to, and substantially aligned with a respective cavity 50 (FIG. 2). As will become apparent, in assembly, the holes 52 are adapted to receive the blade-shaped contact portion 42 of a respective header contact 40. The blade-shaped contact portion 42 contacts the beam-shaped contact portion 70 of a respective signal conductor 30 upon insertion into the respective hole 52. Like the header contacts 40, the number, pattern, dimensions and spacing of the holes 52 and corresponding cavities 50 can be varied in order to optimize the tradeoffs between connector requirements.

The insulative receptacle 24 further includes a channel 48 adapted to receive the shield plate 22 of an adjacent, stacked shield subassembly 16 in order to secure adjacent modules 14*a*–14*n* together to form the stacked arrangement of FIG. 1. Thus, the height of the insulative receptacles 24 determines the spacing between adjacent modules 14*a*–14*n* of the modular connector 12. It will be appreciated by those of ordinary skill in the art however, that alternative mechanisms are possible for securing together adjacent modules.

In the illustrative embodiment, the shield subassembly 16 further includes an insulative member 32 for engaging an insulative member 90 of the respective signal subassembly 18 (FIG. 5). To this end, the insulative member 32 includes a lip 34 adapted to fit over the insulative member 90 of the signal subassembly. With this arrangement, once the connector 12 is assembled and mounted to the board 28, the signal subassemblies cannot be removed from the board without also removing the shield subassemblies, thereby further holding the modules 14*a*–14*n* together. Additionally, the insulative member 32 serves to guarantee the pitch of the shield subassembly with respect to the respective signal subassembly and also provides forces to counteract the forces on the tails 72 as they are pressed into the board 28 (i.e., facilitates insertion of the tails 72 and prevents the tails 72 from being pushed back up into the connector 12).

Figure 1A:
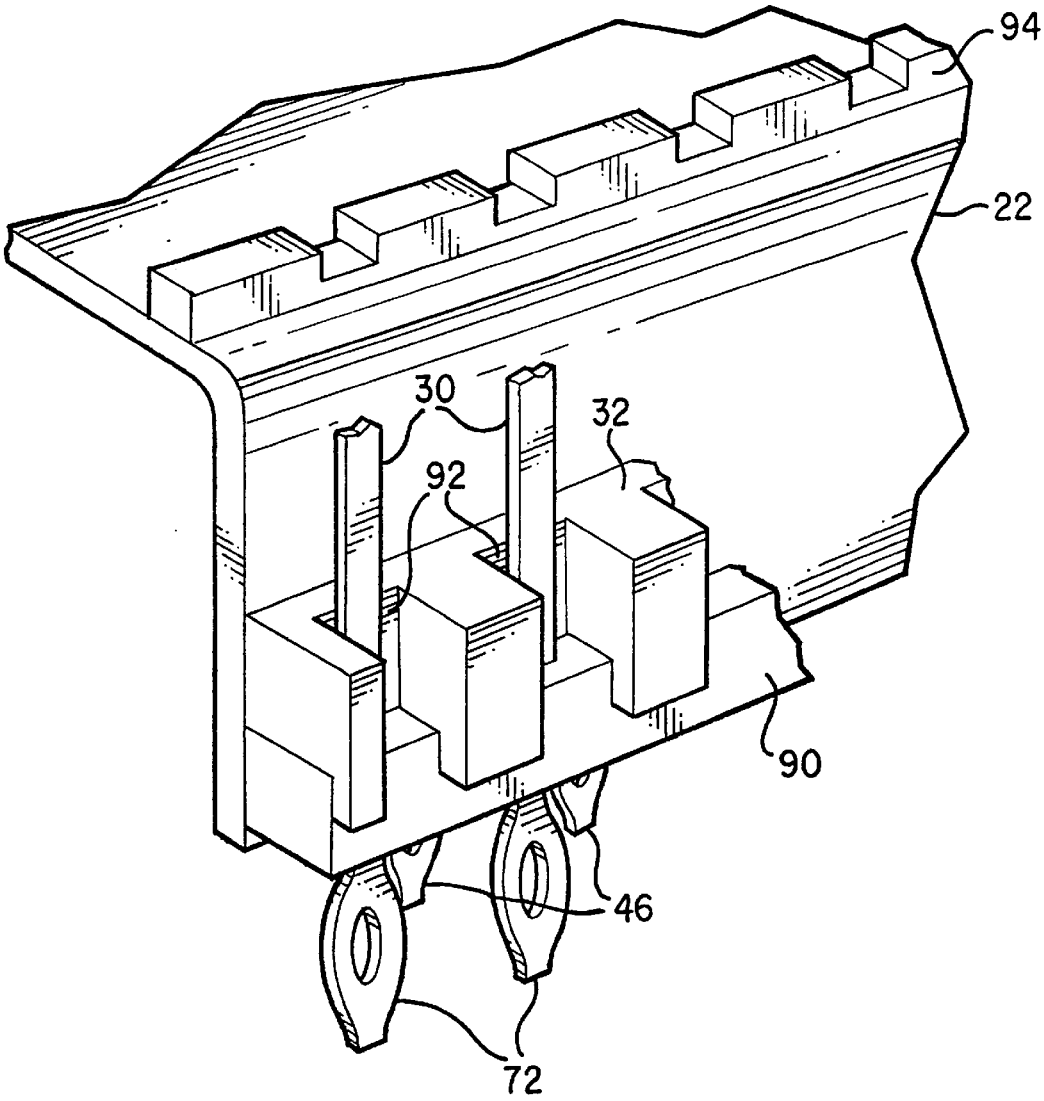
FIG. 1A is an alternate view of a portion of the modular connector of FIG. 1.

Referring also to FIG. 1A, the rear view of a portion of the connector 12 of FIG. 1 reveals that the insulative member 32 has a plurality of slots 92 through which respective signal conductors 30 extend. FIG. 1A also shows a further optional insulative standoff 94 which is molded to the shield plate 22 at the same time as the insulative member 32.

Various manufacturing techniques are suitable for forming the shield subassembly 16. As one example, the shield plate may be stamped from a conductive metal sheet of copper alloy with suitable spring characteristics to provide its features, such as the apertures 54 and conductive members 46, and then may be formed or bent to achieve the right angle bend and to slightly bend the signal retention tabs 58. In the illustrative embodiment, the insulative receptacle 24 and the insulative member 32 are insert molded to the shield plate 22. For this purpose, the shield plate includes apertures into which the plastic flows. It will be appreciated by those of ordinary skill in the art however, that other manufacturing techniques are suitable, such as assembling a prefabricated insulative receptacle 24 and insulative member 32 onto the shield plate 22.

Referring also to FIG. 5, an illustrative signal subassembly 18 includes a plurality of signal conductors 30, a first insulative member, or spacer 64 having an attachment mechanism 78, and a second insulative member, or spacer 90. Each of the conductors 30 has a first end 30*a* at which is disposed a beam-shaped contact portion 70 and a second end 30*b* at which is disposed a conductive element 72 adapted for being electrically connected to the printed circuit board 28.

Each of the beam-shaped contact portions 70 has two substantially independent coplanar beams 76*a*, 76*b*, as shown, with such beams being positioned substantially parallel to the shield plates 22 in assembly (FIG. 2). As will become apparent, each of the beams 76*a* and 76*b* of a signal conductor 30 contacts a common surface of a respective blade-shaped contact portion 42 when the connectors 12 and 36 are mated.

With this arrangement, multiple points of contact provides increased signal density and reduced signal crosstalk and reflections than is generally achievable with the use of conventional pin and box connectors. Further, the pitch between adjacent daughter boards coupled to the backplane 26 with the connector system 10 can be made smaller than heretofore possible. This is because the beam contacts have a substantially reduced profile as compared to conventional box-shaped sockets and contact a single surface of a low profile blade-shaped contact, thereby permitting the use of more contacts within the same connector footprint and/or larger spacing between contacts.

Preferably, each of the beams 76*a*, 76*b* has a contact feature, such as a dimple or protrusion 80, for increasing contact pressure (Hertz stress) exerted on the respective blade-shaped contact portion 42. Use of such a contact feature enhances the predictability of the resulting electrical connection by ensuring the same points of contact during repeated connector uses, increases reliability of the electrical connection and makes the connection less susceptible to intermittency.

Referring also to the side view of FIG. 2, the beam-shaped contact portion 70 of the signal conductors 30 may include a bend 82 provided in order to "preload" the contact by providing a downward force on an inserted blade-shaped contact 42. Additionally, a leading end portion 84 of the beam-shaped contact portion 70 may be angled upward slightly in order facilitate insertion of the respective blade-shaped contact by eliminating the tendency of the blade-shaped contact portion to stub on the beam-shaped contact portion. The angled end portion 84 further tends to reduce the insertion forces on an inserted blade-shaped contact portion 42.

It will be appreciated by those of ordinary skill in the art, that the particular shape and features of the beam-shaped contact portion 70 of the signal conductors 30 may be varied somewhat while still providing the benefits described herein. For example, the substantially coplanar beams 76*a* and 76*b* may be rounded in the manner shown in FIG. 5 or may extend substantially parallel to one another in the manner shown in FIG. 6. It is desirable that the beams 76*a*, 76*b* be sufficiently separated to be capable of independent movement, in order to enhance the integrity of the multiple points of contact. For example, if the contact point between one beam 76*a*, 76*b* and the respective blade 42 is obscured, for example, by a piece of dirt or other interference, the other beam 76*a*, 76*b* is still able to contact the blade. However, the advantages of multiple points of contact that may be achieved by separating the beams 76*a*, 76*b* must be weighed against the desirability of having relatively narrow beam-shaped contact portions 70, in order to permit sufficient spacing between adjacent contact portions 70 to minimize crosstalk.

The number, dimensions and spacing of the signal conductors 30 can be readily varied to suit a particular application and more particularly, to optimize connector requirements. For example, the width and the spacing from ground of the conductors 30 is selected to provide a predetermined minimum electrical impedance, but is no greater than is necessary to provide the matched impedance in order to permit sufficient spacing between adjacent contacts to minimize crosstalk while still providing the connector with overall dimensions sufficient to meet stringent space requirements. In one illustrative embodiment, the signal conductors 30 have a width on the order of 0.012 inches, or 0.3 mm and a thickness on the order of 0.008 inches, or 0.2 mm.

The particular dimensions of the beams-shaped contact portion 70 and the individual beams 76*a*, 76*b* will be further influenced by the choice of materials. As one example, the beam-shaped contact portion 70 is comprised of copper alloy with suitable spring characteristics and has a width on the order of 0.040 inches or 1 mm, a thickness on the order of 0.008 inches, or 0.20 mm and a length on the order of 0.120 inches, or 3 mm and each beam 76*a*, 76*b* has a width on the order of 0.015 inches, or 0.381 mm.

The insulative member 64 is molded to encase a portion of the signal conductors 30, as shown, and thus, to hold the conductors together to form a row of conductors. In the illustrative embodiment, the attachment mechanism 78 is provided by tabs extending from a bottom surface of the member 64 to engage holes 54 in the respective shield plate 22 (FIG. 4). Like the conductive elements 46 of the shield plate, the illustrated conductive elements 72 of the signal conductors 30 are "eye of the needle," or "tail" contacts adapted to be press fit into plated holes in the board 28. However, it will be appreciated by those of ordinary skill in the art that the conductive elements 72 may take various forms, such as surface mount elements, spring contacts, solderable pins, etc.

The second insulative member 90 is similarly molded to encase a portion of the signal conductors 30. The insulative members 64 and 90 serve to space the signal conductors 30 from the respective shield plate 22 by a predetermined amount. It will be appreciated that a different number of insulative members having different form factors may be used to form the signal subassembly 18. The second insulative member 90 serves an additional purpose of interlocking with lip 34 of the insulative member 32 of the respective shield subassembly 16 (FIG. 4).

Various materials and manufacturing techniques are suitable for forming the signal subassembly 18. As one example, the signal conductors 30 are stamped from a piece of metal to provide their features, including conductive members 72 and beam-shaped contact portions 70, and are held together with portions of the stamped metal referred to as carrier strips (not shown). The signal conductors are then formed, such as by bending to provide the substantially right angle bend and also to provide features of the beam-shaped contact portions 70, including the bend 82, the contact feature 80, and the angled end portion 84 (FIG. 2). The insulative members 64 and 90 are molded to encase a portion of the conductors, thereby holding the contacts together to form a row of signal conductors. Thereafter, the carrier strips are severed to separate and thus, to electrically isolate the conductors 30. It will be appreciated by those of ordinary skill in the art that additional insulative members like members 90 may be used.

Figure 6:
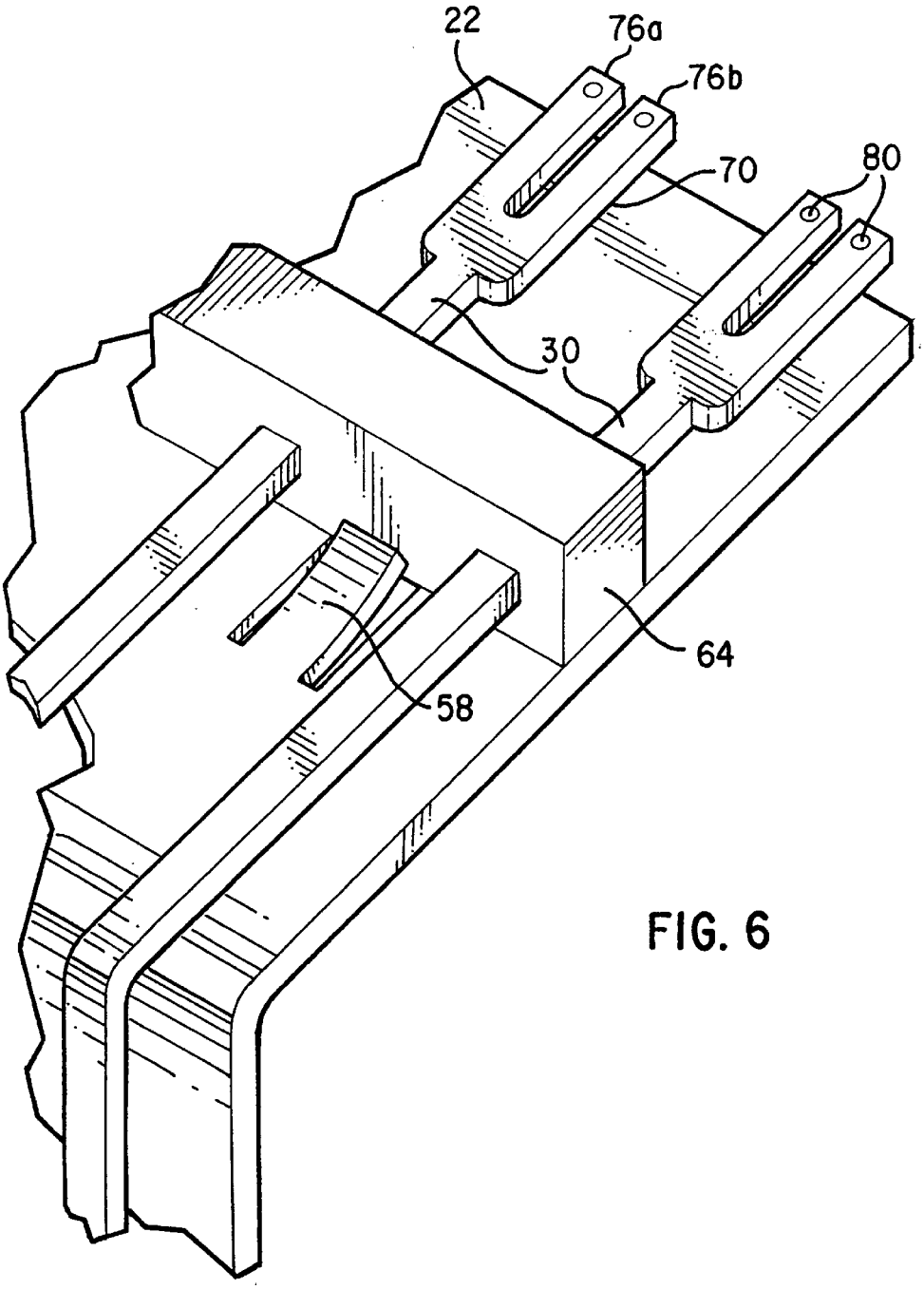
FIG. 6 shows a portion of the signal subassembly of FIG. 5 coupled to the shield subassembly of FIG. 4.

In assembly, each shield subassembly 16 is attached to a respective signal subassembly 18 to form a module 14*a*–14*n*. Referring to FIG. 6, a portion of an illustrative module 14*a* with the receptacle 24 and a portion of connector 36 removed is shown. The signal subassembly 18 is attached to the respective shield subassembly 16 by inserting tabs 78 (FIG. 5) into respective holes 54 of the shield subassembly (FIG. 4). Insertion of the tabs 78 into the holes 54 causes the cantilevered signal retention tabs 58 to rest against the insulative member 64 of the signal subassembly and, further, causes the lip 34 of the shield plate insulative member 32 to engage the signal contact insulative member 90. With this attachment arrangement, the signal subassembly 18 is prevented from being easily removed from the shield subassembly 16, without biasing the signal retention tabs 58.

In use, the blade header 36 (FIG. 2) is brought into alignment with the modular connector 12 so that each of the blade contacts 42 is substantially vertically and horizontally aligned with a respective hole 52 of the stacked insulative receptacles 24. The two connectors 12, 36 are then mated, thereby causing the blade-shaped contacts 42 of the header 36 to enter respective holes 52 of the modular connector 12 and contact the respective beam-shaped contact 70.

Figure 7:
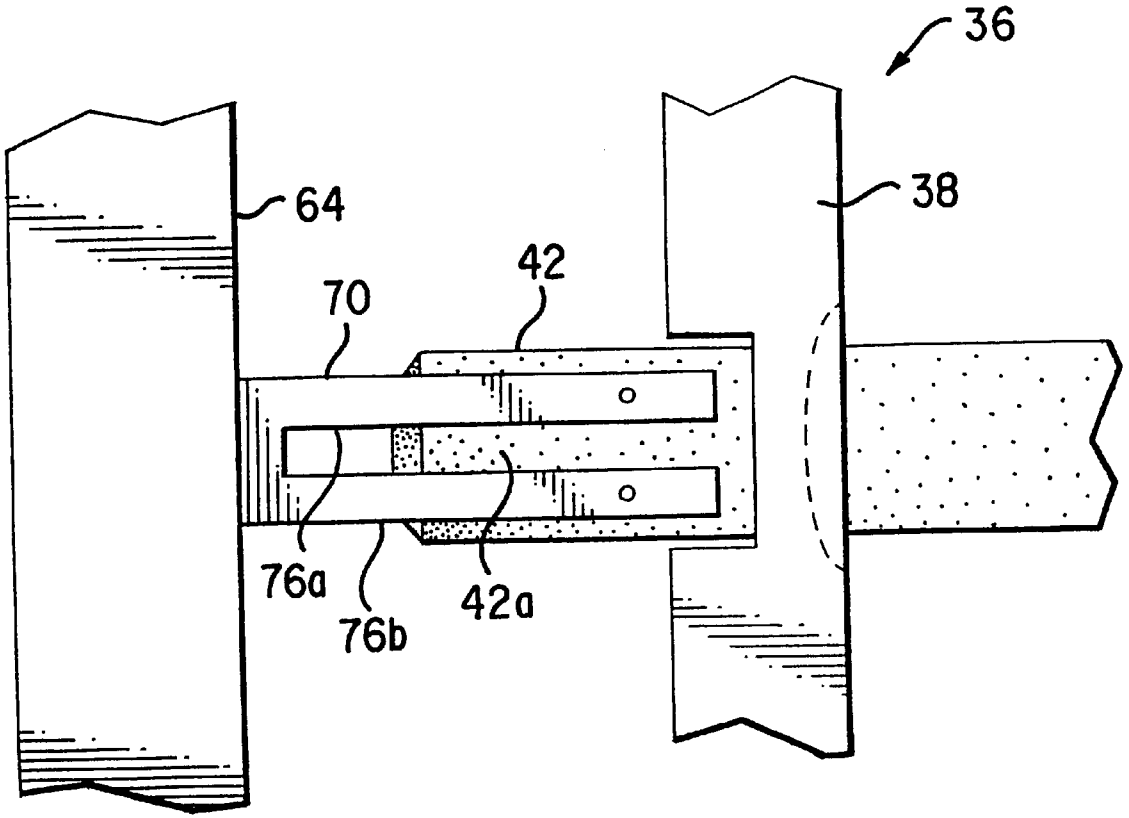
FIG. 7 is a top view of a portion of the signal subassembly of FIG. 5 coupled to the shield subassembly of FIG. 4.

Referring to FIG. 7, a top view of a portion of the connector system 10 (with the insulative receptacle 24 removed) illustrates contact of the split beams 76*a*, 76*b* with a blade-shaped contact 42 of the connector 36. As is apparent, both of the independent beams 76*a*, 76*b* contact a surface 42*a* of the blade 42, thereby providing redundant signal contact points.

Figure 8:
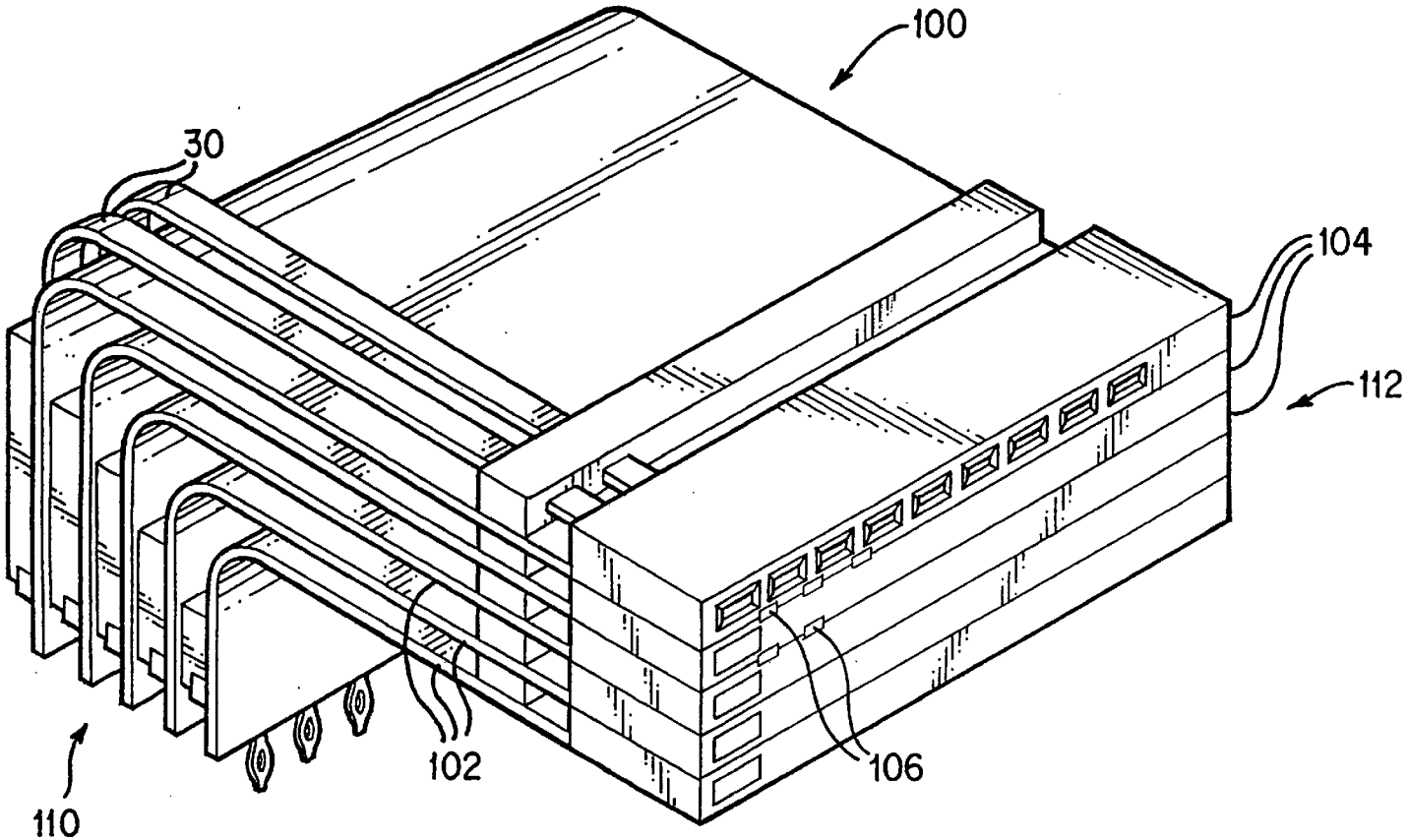
FIG. 8 is an isometric view of an alternate modular connector according to the invention.

Referring also to FIG. 8, in which like reference numbers refer to like elements, an alternate modular connector 100 provides access to the shield plates through a forward end 112 of the connector, thereby permitting the shield plates to be electrically connected to the printed circuit board 26. For this purpose, a forward portion of each shield plate 102 is exposed through a plurality of holes 106 in the respective insulative receptacle 104. The holes 106 are offset from the holes adapted to receive the blade-shaped contacts. With this arrangement, a blade, pin, or other electrical contact of the mating connector can be inserted into the holes 106 to contact the shield plates 102, thereby reducing reflections caused by impedance discontinuities at the point of mating of the two connectors.

Figure 9:
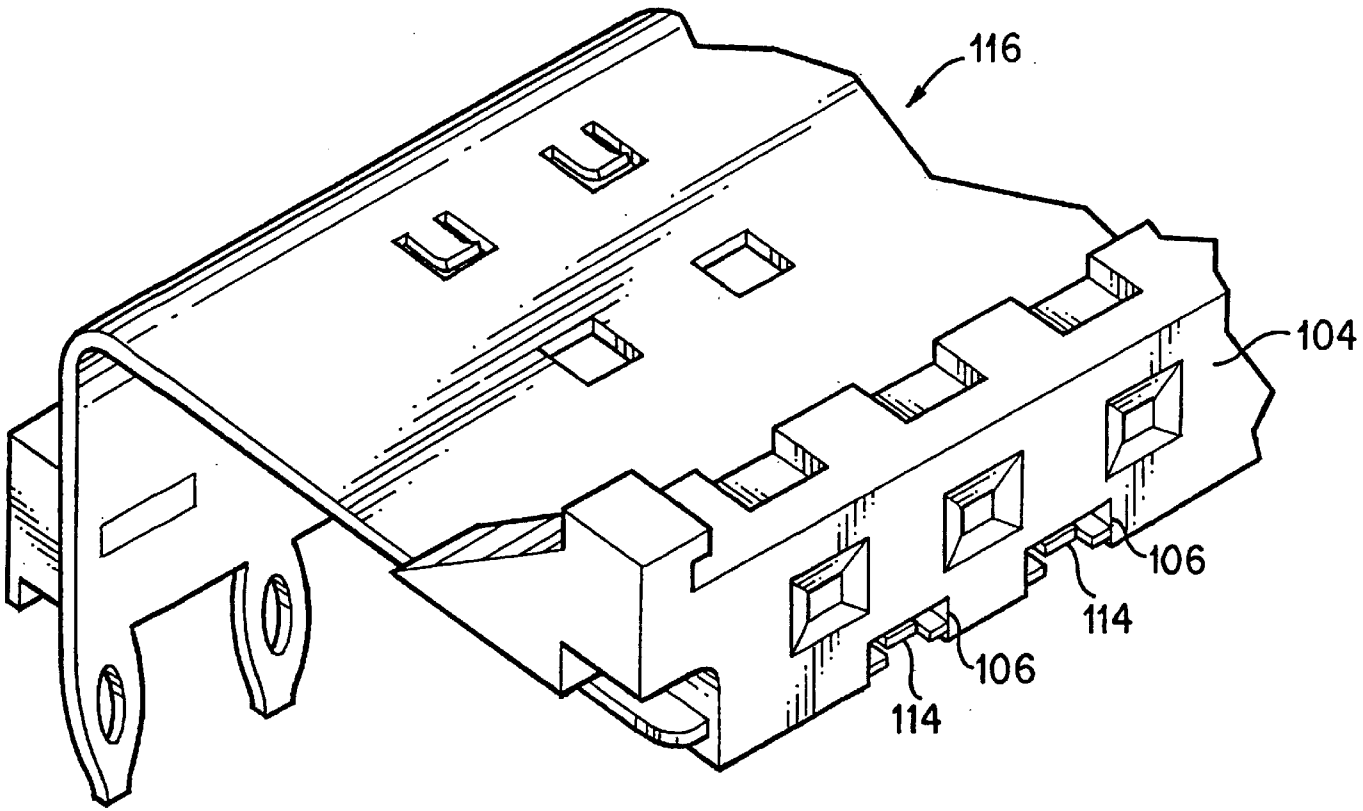
FIG. 9 is an isometric view of an illustrative shield subassembly of the modular connector of FIG. 8.

Referring also to FIG. 9, an illustrative shield subassembly 116 of the connector 100 of FIG. 8 is shown. The portion of the shield plate 102 that extends into the holes 106 includes a contact 114. The contact 114 facilitates electrical contact of the shield plate 102 with a blade, pin, or other electrical contact of a mating connector.

Thus, the insulative receptacles 104 differ from receptacles 24 (FIG. 1) in the addition of holes 106 and the shield plates 102 differ from shield plates 22 (FIG. 1) in the addition of contacts 114. Otherwise, the modular connector 100 is substantially identical to the connector 12 of FIG. 1. Thus, like connector 12, connector 100 includes a plurality of shield plates 102 mounted in parallel, a plurality of insulative receptacles 104, each attached to a respective shield plate, and a plurality of signal conductors 30. Each of the signal conductors 30 has conductive elements disposed at a one end 110 of the connector for being electrically connected to a first printed circuit board and beam-shaped contact portions (like contact portions 70 of FIG. 2) disposed at a second end 112 and are positioned substantially parallel to the shield plates 102.

Figure 10:
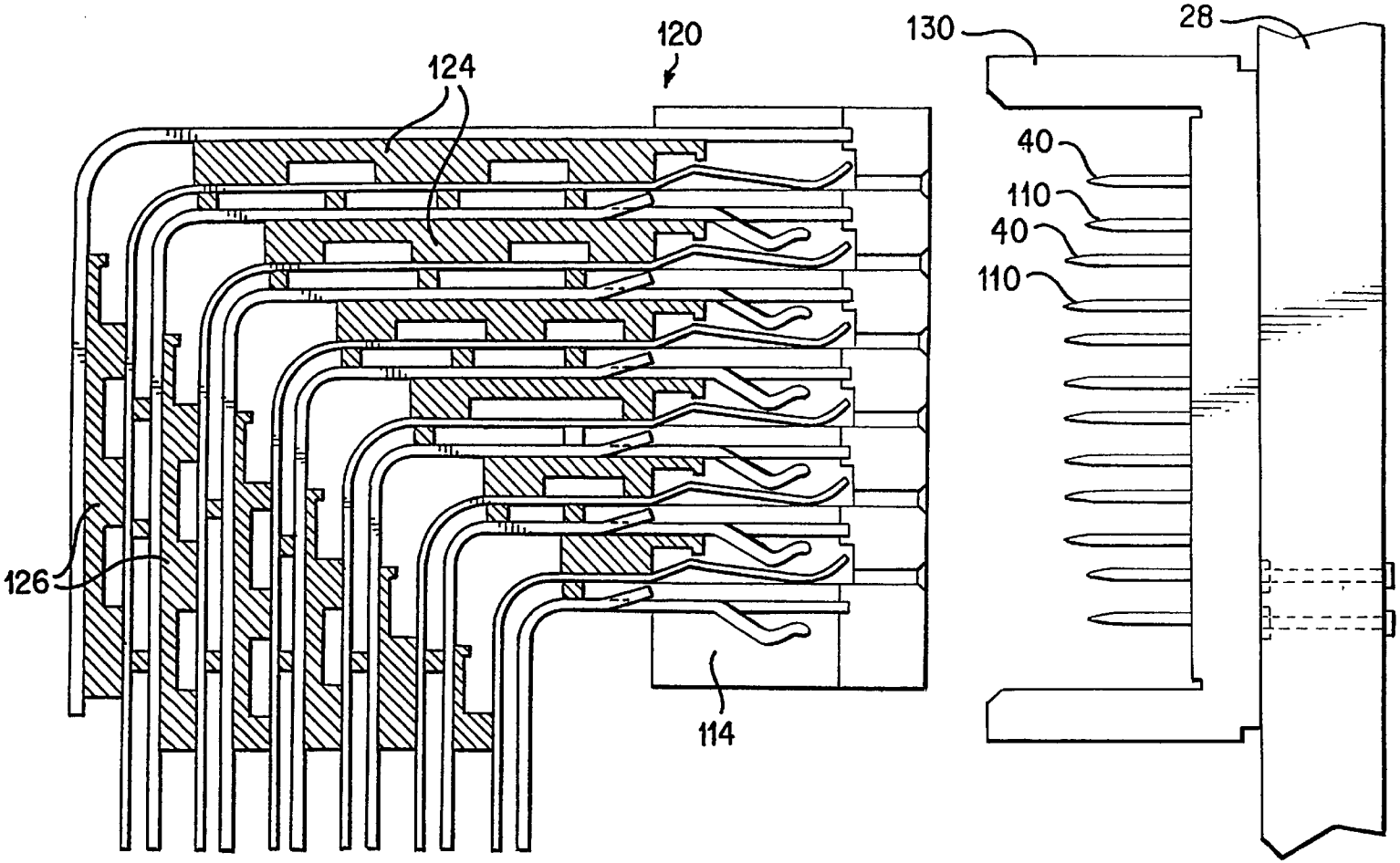
FIG. 10 is a cross-sectional side view of a further alternate modular connector of the present invention.

Referring to FIG. 10, in which like reference numbers refer to like elements, a further alternate modular connector 120, like the connector 100 (FIG. 8), permits the shield plates to be electrically connected to the board 28. In particular, like connector 100, a forward portion of each shield plate 102 of connector 120 is exposed through holes 106 in the respective insulative receptacle 104. In this way, blades, pins, or other electrical contacts of a connector 130 inserted into the holes 106 contact the shield plates 102. Further, the portion of the shield plate 102 that extends to the holes 106 includes a contact 114.

Connector 120 differs from connector 100 (FIG. 8) only in the form factor and features of the insulative members of the signal subassemblies. In particular, each signal subassembly includes signal conductors 30 of the type described above and further includes a first insulative member 124 and a second insulative member 126. The insulative members 124, 126 include a mechanism for locking the signal subassembly to a respective shield subassembly, like tabs 78 (FIG. 5). Further, the insulative members 126 include a lip feature, like lip 34 (FIG. 4), in order to ensure the relative pitch of the shield subassembly and the respective signal subassembly and also to resist forces on the tail contacts as the shield subassemblies and the signal subassemblies are press fit into a printed circuit board.

Figure 11:
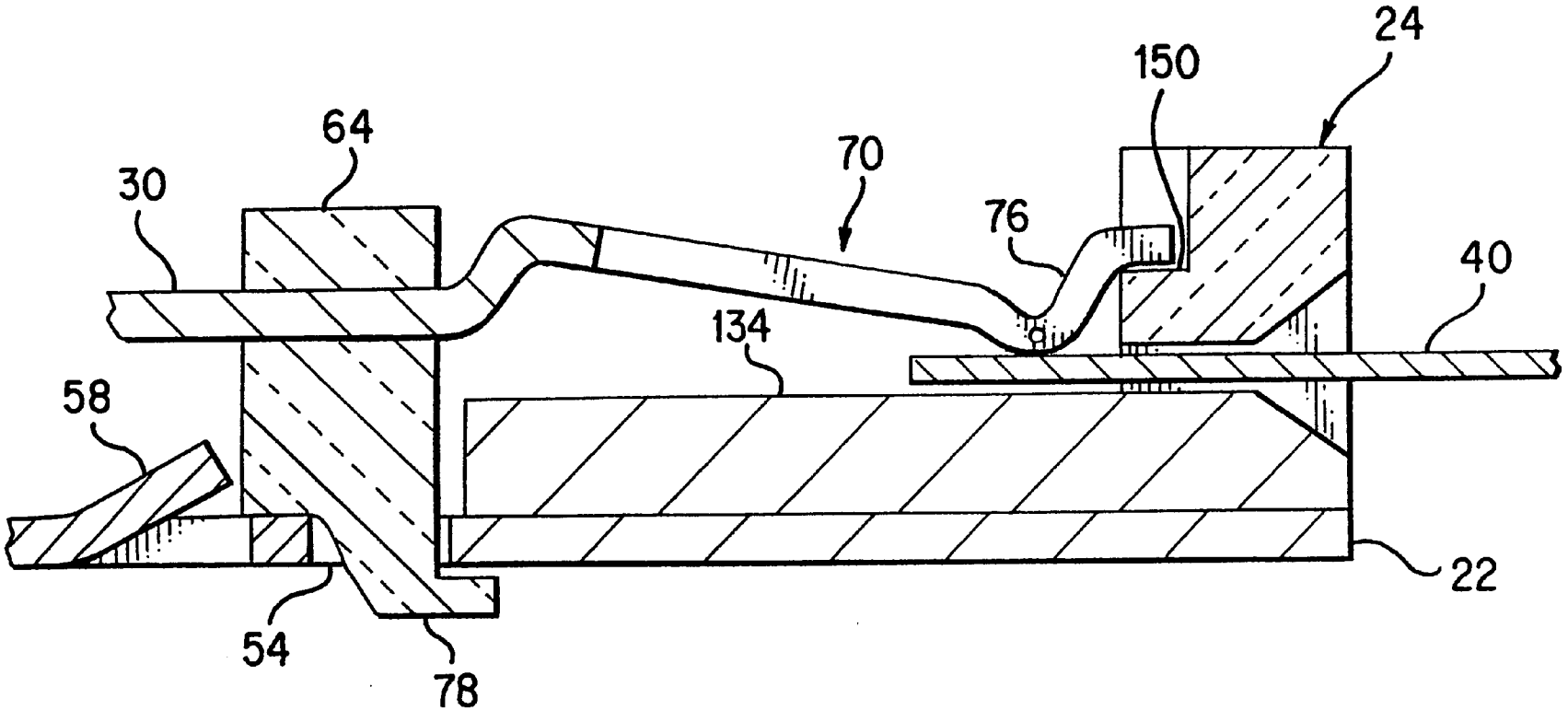
FIG. 11 is a cross-sectional side view illustrating an optional feature of the modular connectors of the invention.

Referring also to FIG. 11, a preferred ledge feature 150 of the connectors 12, 100 and 120 described herein is shown in use with connector 12. The ledge 150 is provided in the insulative receptacle 24 adjacent to each cavity 52 and interferes with the upwardly angled end portion 84 of the beams 76*a*, 76*b* to prevent the beams from touching the wall 134. In this way, the incidence of stubbing and the connector insertion forces are reduced. Further, the ledge 150 aids in the alignment of beam-shaped contact portion 70 with respect to the blade 42 in use, since the ledge is in an axis parallel to the contact length.

It will be appreciated by those of ordinary skill in the art that the connector 12 is readily modular by both row and column. For example, and referring to FIG. 12, to provide a wider connector, two or more connectors 12 can be placed side by side, thereby adding more columns 140*a*–140*n* to the connector system. Further, in order to provide a taller connector, additional modules 14*a*–14*n* can be added and/or two or more connectors 12 including a predetermined number of modules can be stacked, in order to thereby increase the number of rows 142*a*–142*n* of the connector system.

Figures 12, 12A, 13:
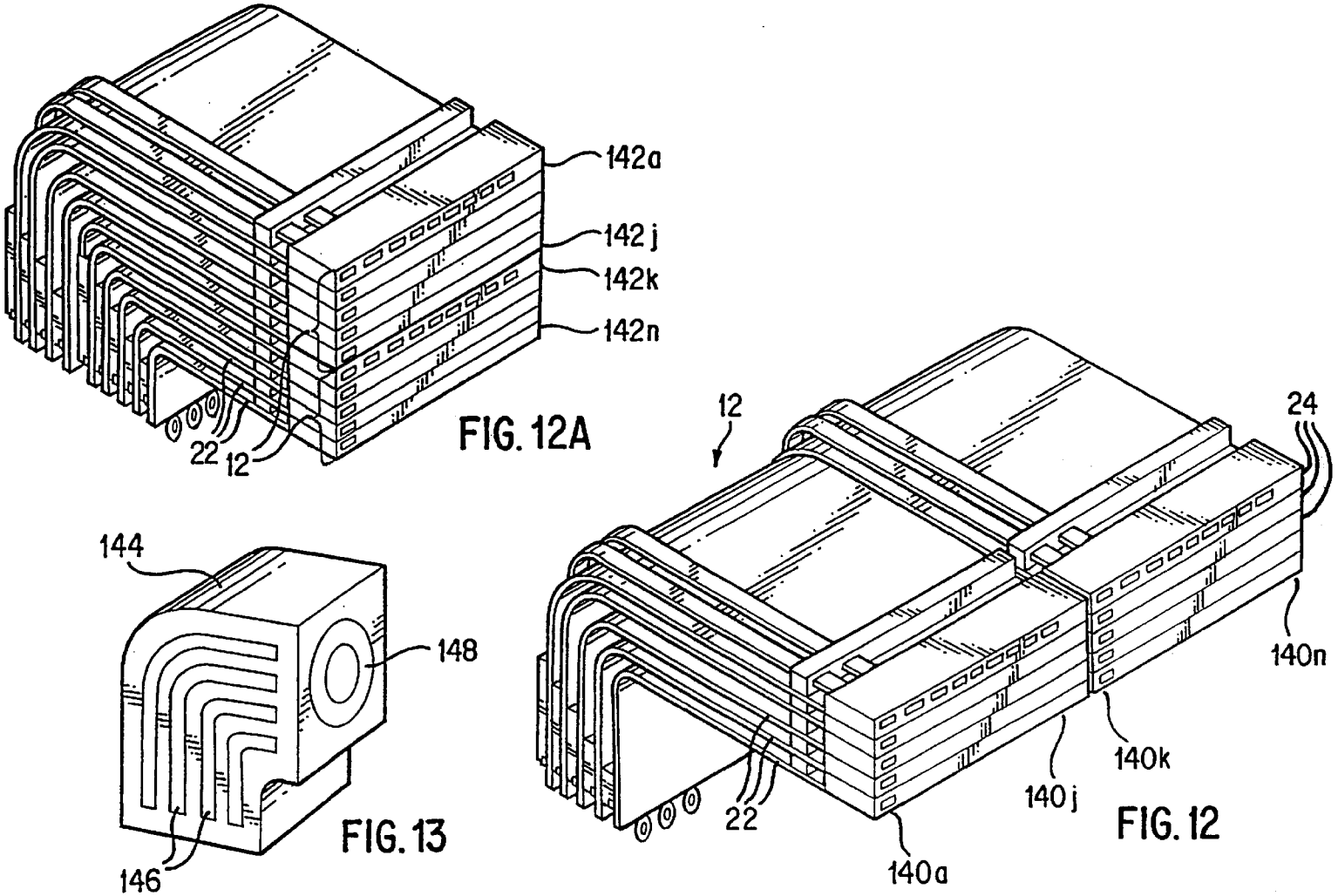
FIG. 12 illustrates the column modularity of the connector of FIG. 1.
FIG. 12A illustrates the row modularity of the connector of FIG. 1.
FIG. 13 shows an end cap for use with the connector of FIG. 1.

Referring to FIG. 13, an end cap 144 is shown to include a plurality of slots 146 and a guide pin receptacle 148. In use, the end cap 144 is placed on either side of the connector 12 and the individual modules 14*a*–14*n* are inserted into a respective slot 146 in order to cover the ends of the modules. The guide pin receptacle 148 is adapted to receive a guide pin extending from the backplane 26 (FIG. 2) in order to facilitate mating of the connector 12 to the backplane connector 36.

Having described the preferred embodiments of the invention, it will now become apparent to one of ordinary skill in the art that other embodiments incorporating their concepts may be used.

It will be appreciated by those of ordinary skill in the art that the structures and techniques described herein including, for example, the beam-shaped contact portions 70 mating with blade-shaped contacts and the substantially parallel positioning of the beam-shaped contact portions with respect to the ground plates, can be realized in a straight line connector which interconnects parallel boards. Thus, such a connector is substantially identical to the connector 12, but without the right-angle bend in the signal subassemblies and the shield subassemblies.

It is felt therefore that these embodiments should not be limited to disclosed embodiments but rather should be limited only by the spirit and scope of the appended claims. All publications and references cited herein are expressly incorporated herein by reference in their entirety.

What is claimed is:

1. A modular connector for accepting a blade-shaped contact comprising:

a plurality of insulative receptacles;

a plurality of signal conductors, each having a first end with a conductive element adapted for being electrically connected to a printed circuit board and a second end having a beam-shaped contact portion with at least two substantially independent coplanar beams positioned within one of said insulative receptacles, and each independent coplanar beam adapted for contacting a common surface of the blade-shaped contact;

a plurality of shield plates, each one mounted in parallel with a corresponding one of the plurality of signal conductors, each of said plurality of shield plates having a first plate end at which said respective insulative receptacle is attached and a second plate end disposed in a proximity of said conductive element;

a first insulative member disposed at the first ends of said signal conductors and adjacent to said insulative receptacle to form a row of signal conductors; and a second insulative member disposed at the second ends of said signal conductors opposite to said first ends; and wherein a plane of each of said shield plates including said row of said first end signal conductors at said first plate end is substantially orthogonal to a plane of each of said shield plates at said second plate end including said row of said second end signal conductors.

2. The modular connector of claim 1 wherein said two substantially independent coplanar beams have independent movement.

3. The modular connector of claim 2 wherein each of said substantially independent coplanar beams has a contact feature adapted for contacting a common surface of the blade-shaped contact.

4. The modular connector of claim 2 wherein each of said substantially coplanar beams has a bend such that each of said substantially coplanar beams is preloaded by providing a downward force on the inserted blade-shaped contact.

5. The modular connector of claim 2 wherein each of said substantially coplanar beams has a leading end portion adapted to facilitate the insertion of the blade-shaped contact in said receptacle.

6. The modular connector of claim 1 wherein each of said insulative receptacles has a first side in which a cavity is provided for receiving the beam-shaped contact portion of a respective signal conductor and a second side in which a hole is provided in substantial alignment with said cavity for receiving the blade-shaped contact.

7. The modular connector of claim 1 wherein each of said plurality of insulative members is molded around a portion of said signal and includes an attachment mechanism for attaching said insulative member with the row of signal conductors to a respective shield plate.

8. The modular connector of claim 7 wherein each of said shield plates further comprises an engagement mechanism for engaging said attachment mechanism of said insulative member.

9. The modular connector of claim 1 wherein a portion of each of said shield plates extends through said respective insulative receptacle to permit access to said first end of said shield plate.

10. The modular connector of claim 1 wherein each of said signal conductors has a substantially right angle bend between said first and second ends.

11. The modular connector of claim 1 wherein said contact feature comprises:

a protrusion disposed on said beam-shaped contact portion for increasing contact pressure.

12. A modular connector system comprising:

(a) a first connector comprising:

(i) an insulative housing; and (ii) an array of contacts supported by said insulative housing, each contact having a first end with a conductive element adapted for being electrically connected to a first circuit board and a second end having a blade-shaped contact portion;

(b) a second connector comprising an array of beam-shaped contacts, each contact positioned at a first end of a signal conductor having a conductive element adapted for being electrically connected to a second circuit board at a second end, wherein each of said beam-shaped contacts comprises at least two coplanar beams and is adapted for contacting a common surface of a respective blade-shaped contact portion of said first connector when said first and second connectors are mated; (c) a plurality of shield plates mounted in parallel, each of said plurality of shield plates having a first plate end at which is disposed said beam-shaped contact array and a second plate end at which is disposed said first end of said signal conductor, wherein a plane of each of said shield plates at said first plate end is substantially orthogonal to a plane of each of said shield plates at said second plate end; and wherein said second connector further comprises a plurality of insulative members, each one molded to a portion at said first of said signal conductors to form a row of signal conductors and a plurality of insulative members, each one molded to a portion at said second end of said signal conductors.

13. The modular connector system of claim 12 wherein each of said coplanar beams has independent movement.

14. The modular connector system of claim 13 wherein each of said substantially coplanar beams has a contact feature adapted for contacting a common surface of said respective blade-shaped contact portion when said first and second connectors are mated.

15. The modular connector system of claim 12 wherein said second connector further comprises a plurality of shield plates mounted in parallel, wherein said beam-shaped contacts are positioned substantially parallel with respect to said shield plates.

16. The modular connector system of claim 15 wherein said second connector further comprises a plurality of insulative receptacles, each one attached to a respective shield plate and having a first side in which a cavity is provided for receiving a respective beam-shaped contact and a second side in which a hole is provided in substantial alignment with said cavity for receiving a blade-shaped contact portion when said first and second connectors are mated.

17. The modular connector system of claim 16 wherein said second connector further comprises an attachment mechanism for attaching said insulative member with the row of signal conductors to a respective shield plate.

18. The modular connector system of claim 16 wherein a portion each of said plurality of shield plates extends through the respective insulative receptacle for contacting a respective blade-shaped contact portion of said first connector when said first and second connectors are mated.

19. The modular connector system of claim 18 wherein said portion of each of said plurality of shield plates which extends through said respective insulative receptacle comprises a cantilevered signal retention tab for contacting said blade-shaped contact portion.

20. A modular connector comprising:

a plurality of signal conductors, each of the signal conductors having a first end with a beam-shaped contact portion and a second end with a conductive element adapted for being electrically connected to a printed circuit board, each beam-shaped contact portion having at least two independent coplanar beams with independent movement;

a first insulative member adapted to hold the plurality of signal conductors in a spaced arrangement at the first end of each signal conductor;

a second insulative member adapted to hold another portion of each of the plurality of signal conductors in a spaced arrangement at the second end of each signal conductor;

an insulative receptacle having a plurality of holes, each hole corresponding to, and substantially aligned with the beam-shaped contact portion of a respective signal conductor; and wherein each one of the two substantially independent coplanar beams comprises an angled end portion and wherein the insulative receptacle further comprises a ledge adjacent each one of the plurality of holes, the ledge disposed to mate with the angled end portion of each one of the two substantially independent coplanar beams to prevent the beams from touching an opposing wall within the insulative receptacle.

21. The modular connector of claim 20 wherein said first insulative member comprises an attachment mechanism and the insulative receptacle further comprises a channel adapted to receive a shield plate of an adjacent insulative receptacle to secure adjacent insulative receptacles together to form a stacked arrangement and an attachment hole to mate with the attachment mechanism of the first insulative member.

22. A modular connector system comprising:

a first connector comprising:

an insulative housing; and an array of contacts supported by said insulative housing, each contact having a first end with a conductive element adapted for being electrically connected to a first circuit board and a second end having a blade-shaped contact portion; and a second connector comprising:

an array of beam-shaped contacts, each contact positioned at a first end of a signal conductor having a conductive element adapted for being electrically connected to a second circuit board at a second end, wherein each of said beam-shaped contacts is adapted for contacting a respective blade-shaped contact portion of said first connector when said first and second connectors are mated; and a plurality of shield plates mounted in parallel, each of said plurality of shield plates having a first plate end at which is disposed said beam-shaped contact array and a second plate end at which is disposed said first end of said signal conductor, wherein a plane of each of said shield plates at said first plate end is substantially orthogonal to a plane of each of said shield plates at said second plate end;

wherein said second connector further comprises:

a plurality of shield plates mounted in parallel, wherein said beam-shaped contacts are positioned substantially parallel with respect to said shield plates;

a plurality of insulative receptacles, each one attached to a respective shield plate and having a first side in which a cavity is provided for receiving a respective beam-shaped contact and a second side in which a hole is provided in substantial alignment with said cavity for receiving a blade-shaped contact portion when said first and second connectors are mated; and a plurality of insulative members, each one molded to a portion of said signal conductors to form a row of signal conductors and having an attachment mechanism for attaching said insulative member with the row of signal conductors to a respective shield plate.

* * * * *

UNITED STATES PATENT AND TRADEMARK OFFICE

CERTIFICATE OF CORRECTION

PATENT NO. : 6,565,387 B2
DATED : May 20, 2003
INVENTOR(S) : Thomas S. Cohen

It is certified that error appears in the above-identified patent and that said Letters Patent is hereby corrected as shown below:

Column 1,
Line 32, reads “daughter boards” and should read -- “daughter boards” --.
Line 49, reads “N.H.,” and should read -- NH --.

Column 4,
Line 11, reads “30a” and should read -- 30b --.
Line 14, reads “30b” and should read -- 30a --.
Line 38, reads “30a” and should read -- 30b --.
Line 41, reads “30b” and should read -- 30a --.

Signed and Sealed this

Twenty-second Day of July, 2003

JAMES E. ROGAN
*Director of the United States Patent and Trademark Office*